US007163122B2

(12) United States Patent
Elder et al.

(10) Patent No.: US 7,163,122 B2
(45) Date of Patent: Jan. 16, 2007

(54) CONTAINER

(75) Inventors: Andrew W. Elder, Carmel, IN (US); William J. Skinner, Pendleton, IN (US)

(73) Assignee: Stratis Corporation, Indianapolis, IN (US)

( * ) Notice: Subject to any disclaimer, the term of this patent is extended or adjusted under 35 U.S.C. 154(b) by 247 days.

(21) Appl. No.: 10/619,749

(22) Filed: Jul. 15, 2003

(65) Prior Publication Data

US 2005/0199623 A1 Sep. 15, 2005

(51) Int. Cl.
*B65D 6/10* (2006.01)

(52) U.S. Cl. ..... 220/669; 229/939; 220/671; 220/673

(58) Field of Classification Search ..... 220/670, 220/671, 673, 675; 206/508
See application file for complete search history.

(56) References Cited

U.S. PATENT DOCUMENTS 1,696,341 A * 12/1928 Blanchard ..... 229/199
3,378,164 A * 4/1968 Witzgall ..... 220/643
3,973,721 A * 8/1976 Nakane ..... 220/678
3,994,399 A * 11/1976 Numata et al. ..... 206/594
3,997,072 A * 12/1976 Guth ..... 220/324
4,549,672 A * 10/1985 Rinkewich ..... 220/671
4,946,036 A * 8/1990 Kupersmit ..... 206/386
5,564,589 A * 10/1996 Fu et al. ..... 220/608
5,638,983 A * 6/1997 Bazany ..... 220/642
5,722,328 A * 3/1998 Darby ..... 108/55.1
5,908,135 A * 6/1999 Bradford et al. ..... 220/673
6,021,916 A * 2/2000 Stolzman ..... 220/675
6,056,840 A * 5/2000 Mills et al. ..... 156/217

OTHER PUBLICATIONS

Screen from Stratis Corporation Web Site, www.pallets.com, 1 page, Apr. 1, 2004.
Screens from Stratis Corporation Web Site, www.pallets.com, 5 pages, Mar. 16, 2004.

* cited by examiner

*Primary Examiner*—Nathan J. Newhouse
*Assistant Examiner*—Eugene Lhymn
(74) *Attorney, Agent, or Firm*—Merchant & Gould P.C.

(57) ABSTRACT

A container system includes interchangeable components to form an enclosed container. A base in the form of a pallet, a sidewall and a cover are assembled to form an enclosed container. The containers include nesting portions on the pallet and cover so that containers may be stacked when assembled and the components may also be stacked when in storage and nest to resist lateral sliding. The sidewalls include a first embodiment with single wall construction and a second embodiment with double wall construction. The walls are a corrugated plastic construction and include spaced apart reinforcing rods extending into the flutes. The double wall sidewall includes an inner wall with vertically extending flutes having reinforcing rods inserted into spaced apart ones of the flutes while the outer wall has horizontally extending flutes with one or more reinforcing rods inserted therein to provide added strength. The two versions of the sidewall are interchangeable and nest into receiving channels formed in the cover and the pallet.

13 Claims, 10 Drawing Sheets

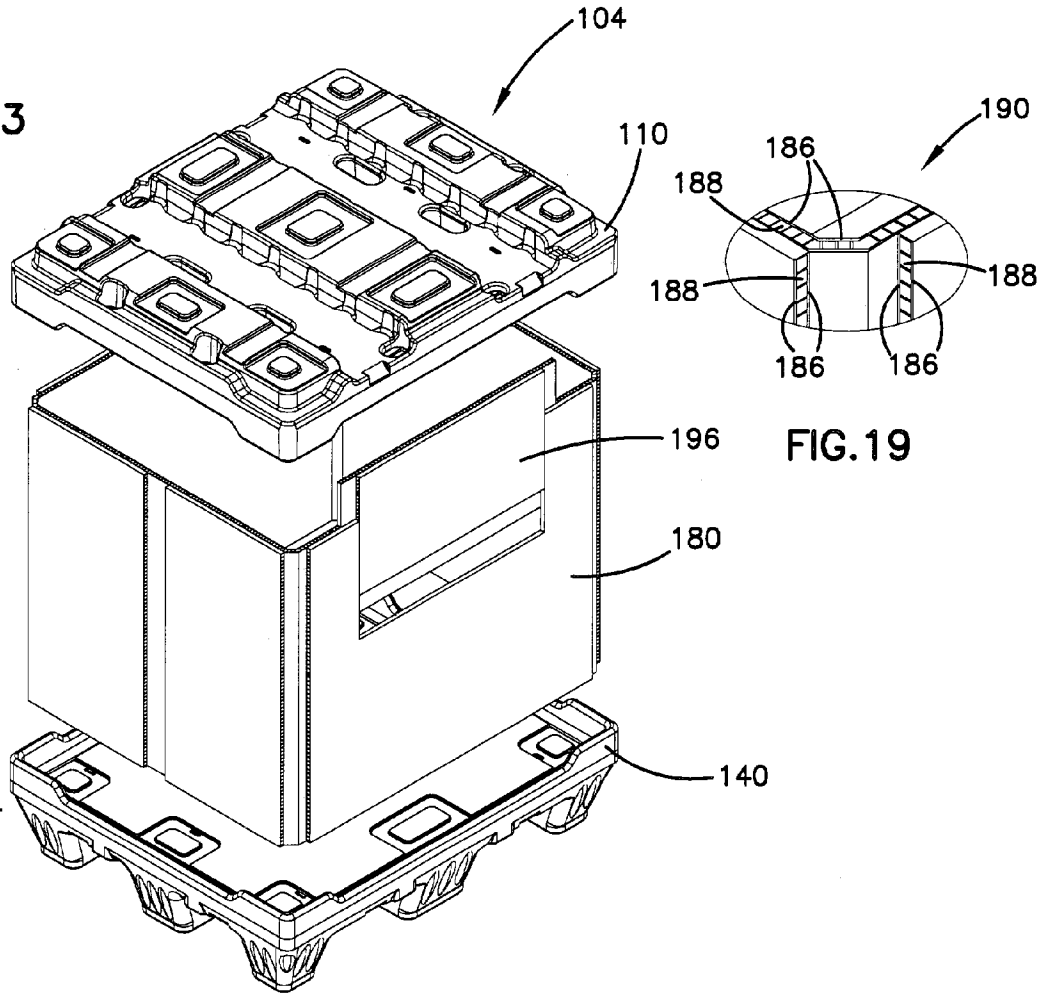
FIG.19
FIG.13
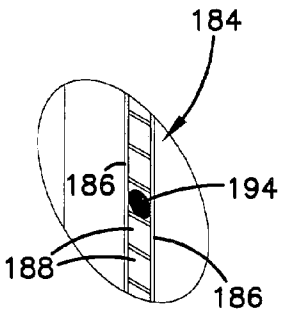
FIG.18

CONTAINER

BACKGROUND OF THE INVENTION

1. Field of the Invention

The present invention relates to a container system, in particular to a lightweight, stackable, high strength container system.

2. Description of the Prior Art

Containers for shipping dense, heavy materials are well known. In order to accommodate and adequately retain and support the materials, the walls of the container must be sufficiently strong. Such containers tend to be made of thick, heavy materials that detract from their utility due to difficulty in handling the containers even when empty. Moreover, it is advantageous to have containers that may be broken down and separated into a cover, base and sidewall elements. The utility of containers further improves if such elements may be stacked when not in use. Such containers further require access by a forklift or pallet jack tines to be useful.

Efforts to achieve lightweight, high strength shipping containers such as are used for shipping paper or other heavy materials have lead to the use of corrugated plastic construction materials. Such materials generally provide a high strength lightweight structure. However, such materials may not have sufficient strength to be comparable to very heavy, dense materials as a sidewall in a container. Moreover, although such materials may have improved strength, the strength benefits may be outweighed by the difficulties of handling heavy material.

It can be seen then that a new and improved container system is needed that can utilize lightweight construction, while having sufficient strength to contain and support dense, heavy materials. Moreover, such a container system should provide for stackability and for breaking down into stackable container components. The present invention addresses these as well as other problems associated with containers.

SUMMARY OF THE INVENTION

The present invention is directed to a container system utilized for transporting heavy objects. The container system of the present invention has a cover, a bottom pallet serving as a base, and a sidewall seating in the cover and the base. The three elements are secured together to create a lightweight, strong container system. Different sizes and structural sidewalls may be interchanged for different needs of the container. The containers are also configured for stacking and nesting while stacked so that they resist sliding relative to one another while stacked.

The cover is typically a molded plastic element that includes channels and recesses formed on an upper surface for receiving straps or other devices for securing the cover and base to the sidewall. The cover also defines an upper surface nesting portions, each including a recess and center that align with legs on the pallet to resist sliding when the containers are stacked. The underside of the cover includes a channel extending spaced slightly inward from the periphery and configured for receiving the sidewall. An outer support portion engages the outside of the sidewall for added alignment and support. Corner portions extend out further to provide additional support at the corners of the sidewall.

The base is a pallet, typically a lightweight, high strength molded plastic pallet. The pallet includes legs extending downward that are spaced apart to receive straps of other securing devices therebetween and configured to receive pallet jacks and forklift tines. The bottom surface of the leg includes an upward extending depression at the center that is complementary to the nesting portions on the upper surface of the cover. In addition, the deck of the pallet also includes nesting portions that are aligned with the legs for stacking and nesting the pallets when not in use and being stored. The upper surface of the pallet also includes a channel in the same configuration as the cover for receiving the lower edge of the sidewall. Support portions extend around a periphery of the pallet and upward to provide support along the lower edge of the pallet with corner portions extending upward and providing increased support to the sidewall.

The sidewall has two interchangeable embodiments according to the present invention. In a first embodiment, the sidewall is a single walled structure while in the second embodiment, the sidewall is double walled. In the first embodiment, the sidewall is typically made of a corrugated plastic material defining vertically extending flutes therein. The sidewall has a typically rectangular footprint forming a center opening with a corner portion extending at approximately a 45 degree angle to the major sides. The sidewall is typically in two sections that are joined along a seam with connecting members typically made of aluminum and defining a channel to seat and engage with one another. Straps extend between the two pieces to hold the elements together. Straps may typically be connected with hook and loop fasteners known under the trade name Velcro®. The rectangular single sidewall seats in the channels in the pallet and the cover for a rigid structure when assembled. For additional support, reinforcing rods are inserted into the flutes of the sidewall with the rods in a spaced apart relationship so that only selected ones of the flutes receive rods. It has been found that with a spaced apart relationship, the sidewall retains the desired quality of being lightweight while achieving the needed strength for support of heavy objects and materials within the container.

In a second embodiment of the sidewall, double wall construction is utilized. As with the first embodiment, a sidewall includes an inner wall with vertically extending flutes and at least one reinforcing rod. In addition, an outer wall is also added. The outer wall is typically also made of a corrugated plastic material, but the flutes are preferably oriented to extend transversely to those of the inner wall, that is horizontally rather than vertically. Moreover, one or more reinforcing rods may also be inserted into the horizontal flutes for added strength. As with the vertical rods, only selected ones of the flutes receive a rod so that the desirable characteristic of a lightweight wall structure is attained with the added benefits of reinforcement for greater strength.

The double walled sidewall may also include a dropdown type door. A panel along one of the walls may be removable to provide access. The double wall allows for overlapping between portions of the door and the rest of the sidewall structure for added strength and alignment. A connection is made by one of several well known devices, including hook and loop type fasteners.

To assemble the containers, the sidewall is inserted and seated into the channel defined in the upper surface of the pallet. In addition, the cover having a similar channel is placed on the sidewall for seating. Securing devices are then wrapped around the cover and the pallet to retain the separable elements of the container system together.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

FIG. 13 is an exploded perspective view of a container shown in FIG. 12;

FIG. 18 is a detail view of flutes and reinforcing members for the sidewall shown in FIG. 14; and FIG. 19 is a detail view of a corner of the sidewall shown in FIG. 14.

DETAILED DESCRIPTION OF THE PREFERRED EMBODIMENT

Figure 1:
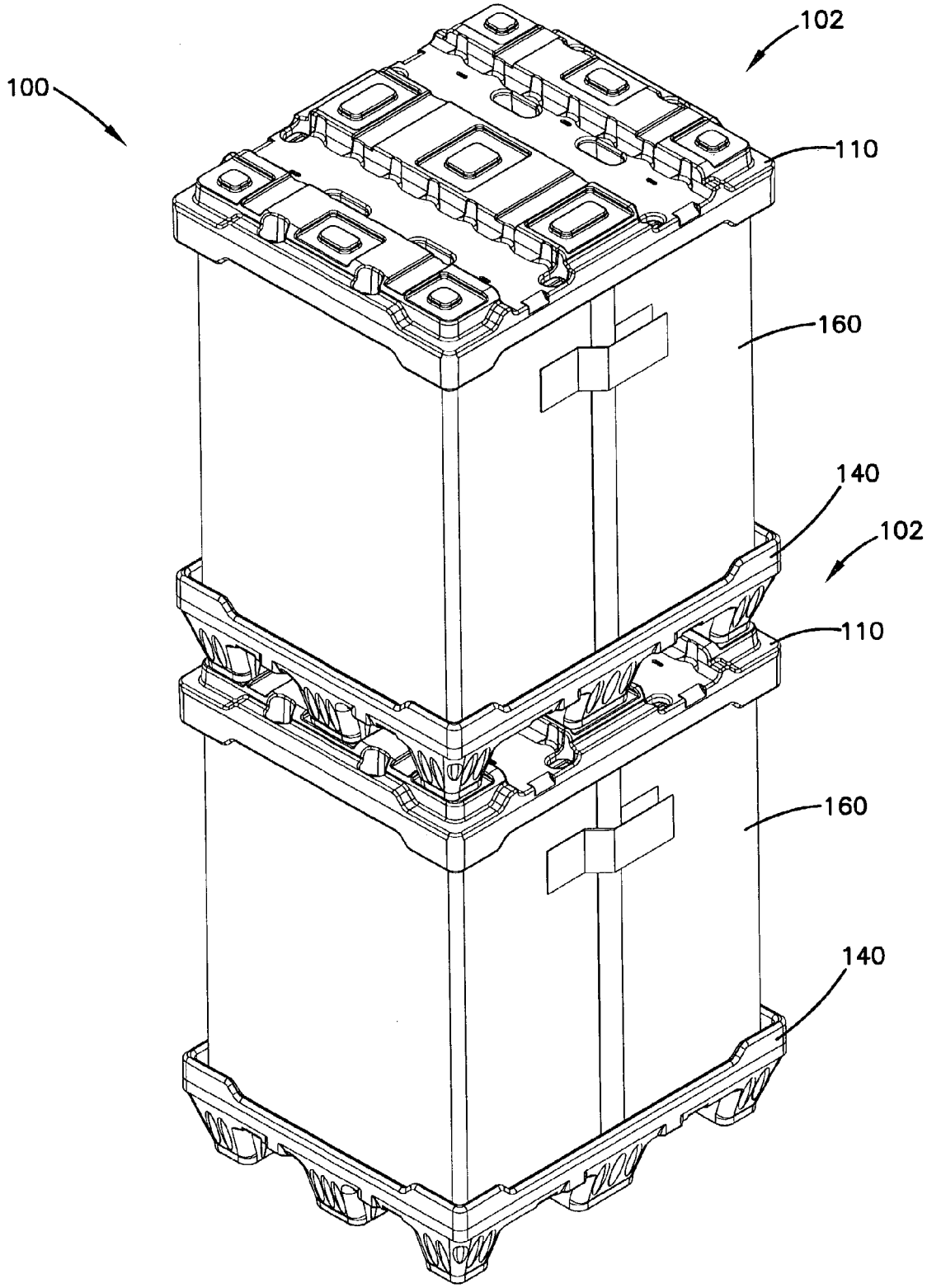
FIG. 1 is a perspective view of a first embodiment of stacked containers according to the principles of the present invention.
Figure 2:
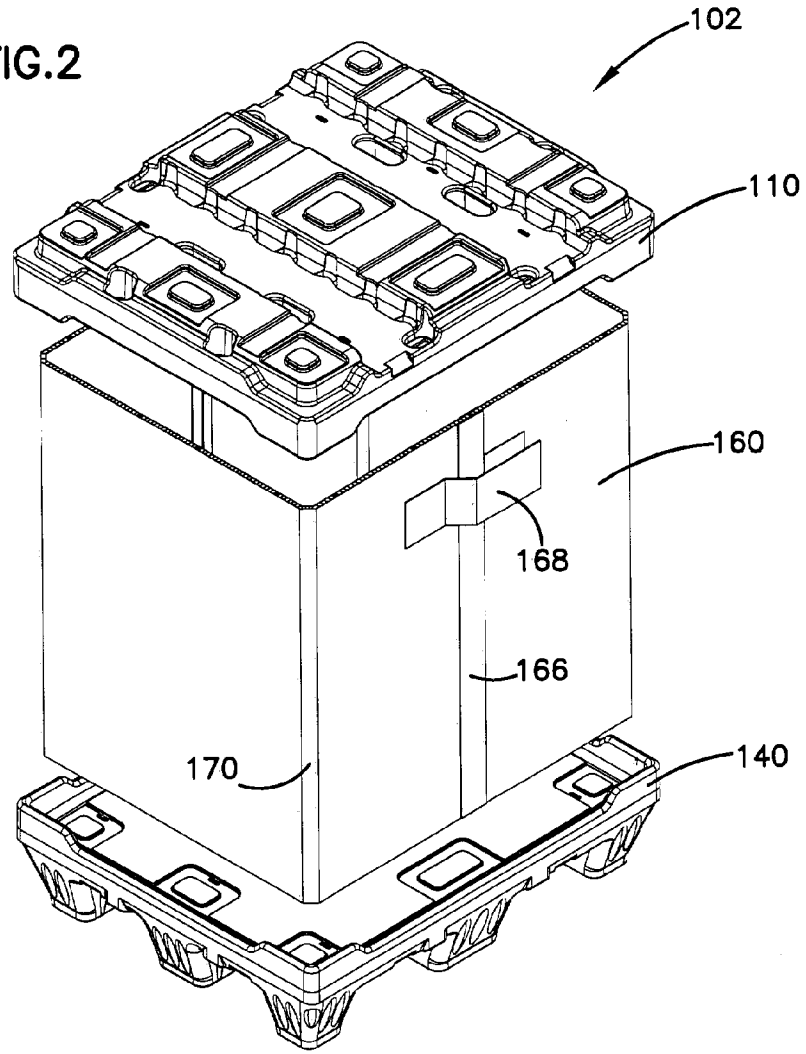
FIG. 2 is an exploded perspective view of a container shown in FIG. 1.
Figure 12:
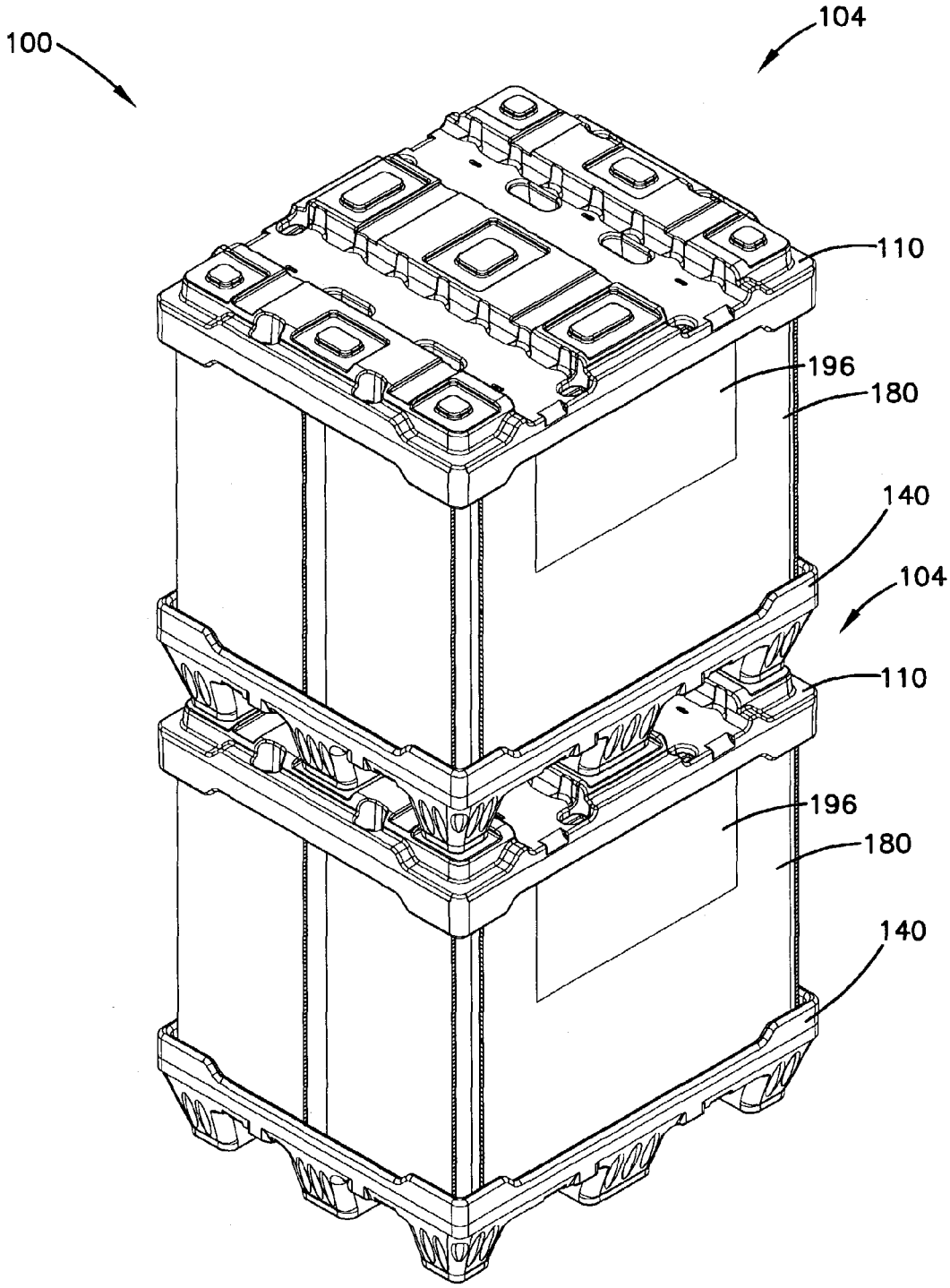
FIG. 12 is a perspective view of a second embodiment of stacked containers according to the principles of the present invention.
Figure 14:
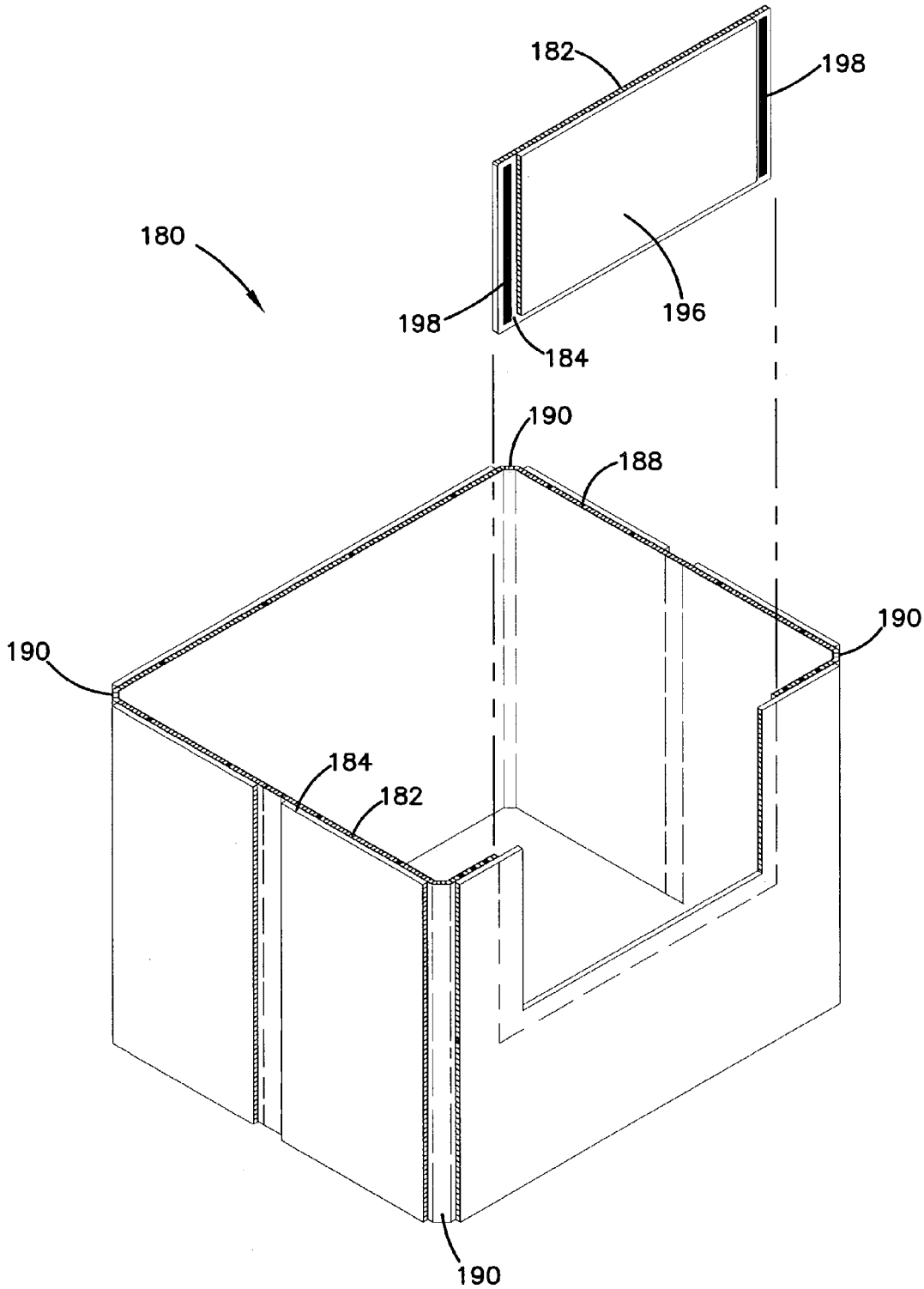
FIG. 14 is an exploded perspective view of a sidewall for the container shown in FIG. 13.
Figure 15:
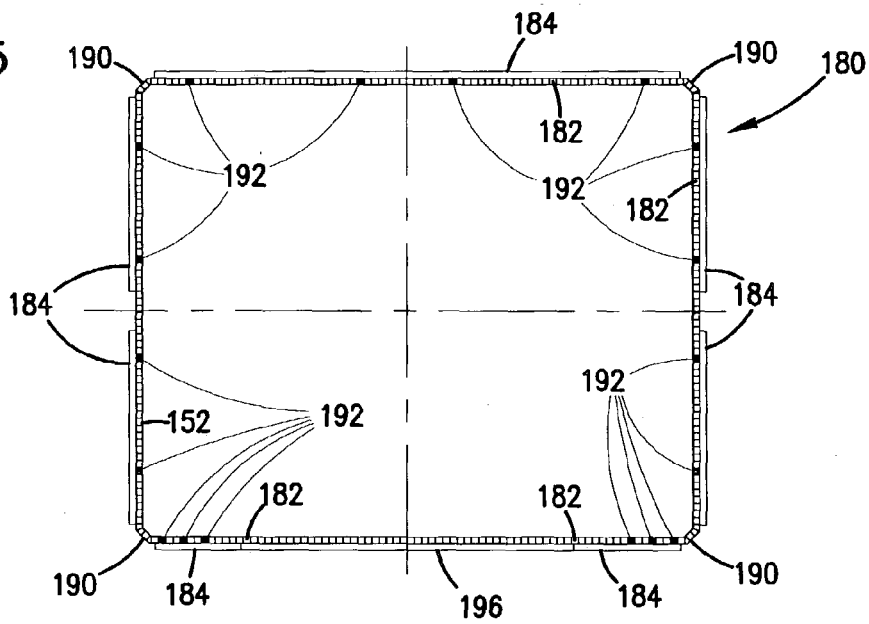
FIG. 15 is a top plan view of the sidewall shown in FIG. 14.
Figure 16:
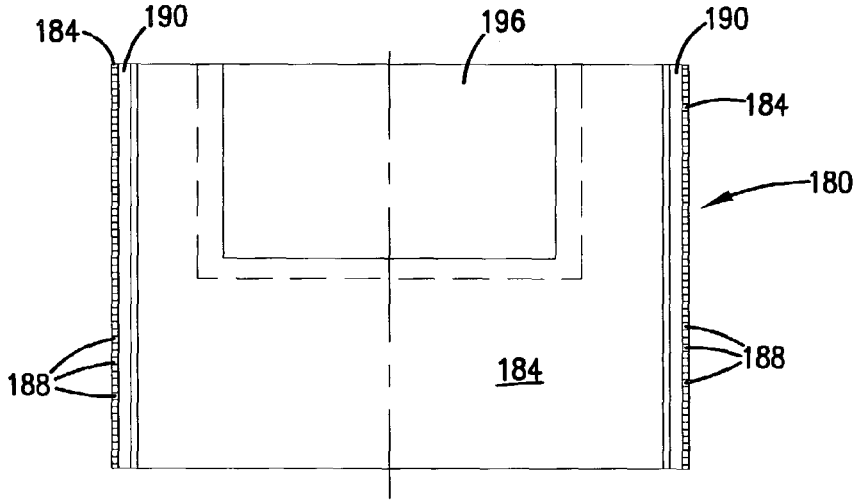
FIG. 16 is a side elevational view of the sidewall shown in FIG. 14.
Figure 17:
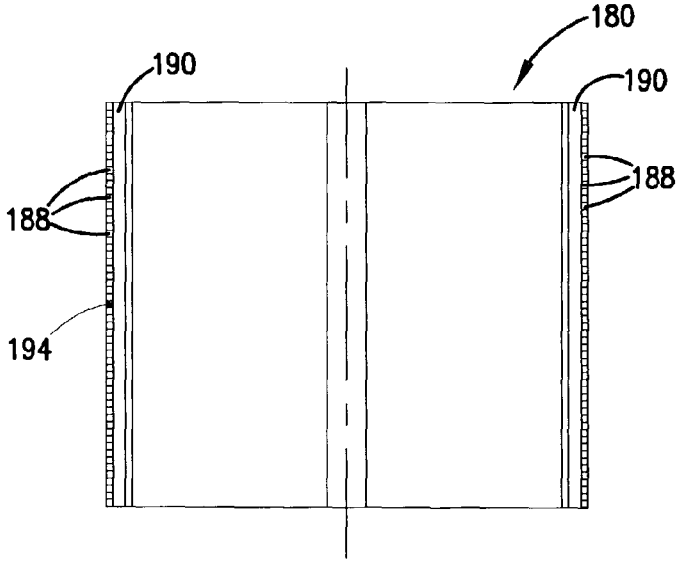
FIG. 17 is a front elevational view of the sidewall shown in FIG. 14.

Referring now to the drawings, wherein like reference numerals and letters indicate corresponding structure throughout the several views, there is shown a container system, generally designated 100. As shown in FIG. 1, the container system 100 includes a first embodiment shown in FIG. 1 and generally designated 102, and a second embodiment of the container system, generally designated 104, shown in FIG. 12. Each of the containers 102 and 104 include interchangeable covers 110 and interchangeable pallet bases 140. The first embodiment 102 also includes a sidewall 160 while the second embodiment 104 has a sidewall 180, shown respectively in FIGS. 2 and 13. As explained hereinafter, the sidewall portions 160 and 180 are interchangeable and may be utilized with the same cover 110 and pallet 140. Moreover, the containers 102 and 104 are both stackable with the other embodiment as well.

Figure 4:
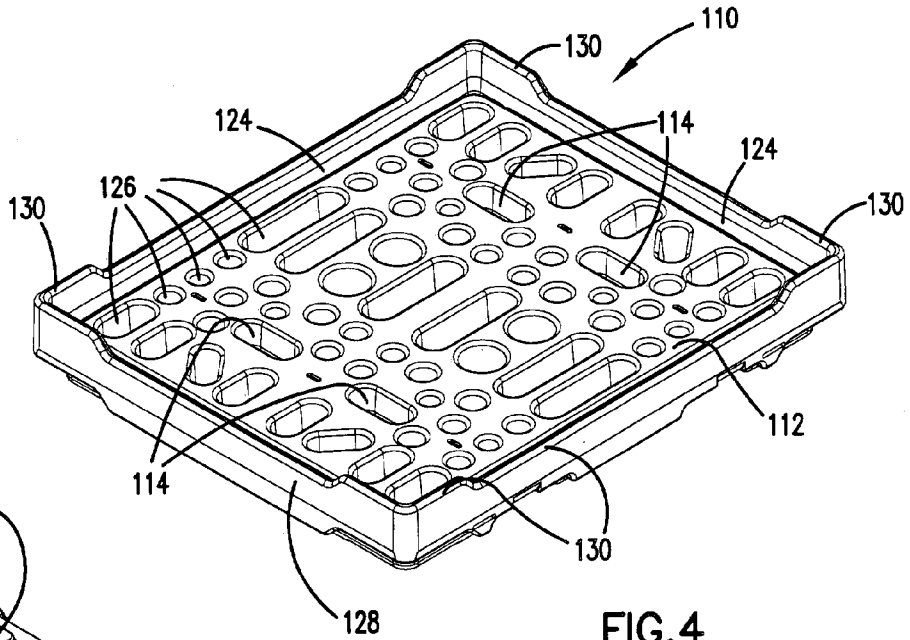
FIG. 4 is a bottom perspective view of the cover shown in FIG. 3.
Figure 3:
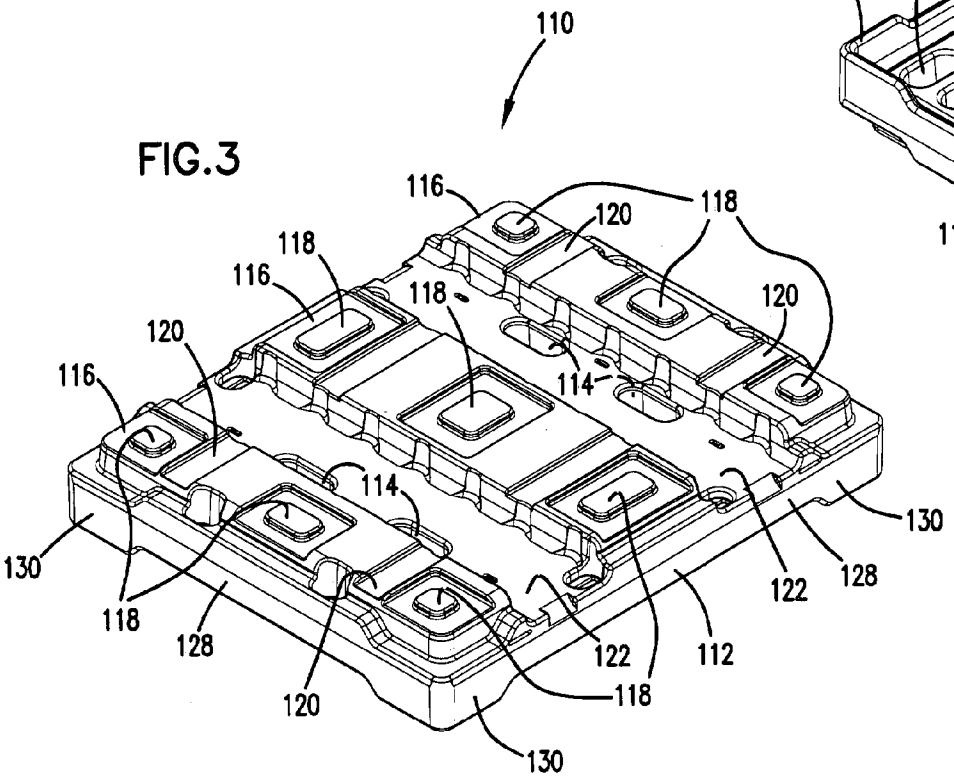
FIG. 3 is a top perspective view of a cover for the container shown in FIG. 2.

Referring now to FIGS. 3 and 4, the cover 110 includes a planar deck portion 112 configured for covering the corresponding sidewall and generally having a rectangular shape. The cover 110 defines three raised sections having channels 122 separating them. The channels 122 are configured for receiving straps or other tie-down devices to secure the cover sidewall and base. The three raised sections 116 have nesting portions 118 formed therein. The nesting portions 118 generally include a recess surrounding a raised center portion. The recess is configured for receiving the bottom legs of the pallet, as explained hereinafter, with the center portion extending upward into a bottom opening formed in the legs. This resists lateral sliding when the containers are stacked. Between the nesting portions 118 are strap receiving recesses 120 extending transverse to the channels 122. In this manner, retainers to tie down the cover and base may extend in a front to back and side to side direction. The cover 110 also defines hand holds 114 to allow for easier handling of the cover 110.

Referring to FIG. 4, the underside of the cover 110 defines a sidewall receiving channel 124 configured for receiving the sidewall when assembled. A side support 128 extends around the periphery of the cover 110 and adjacent the sidewall receiving channel 124. When assembled, the sidewall seats in the channel 124 and is supported by the outer wall support 128. In addition, raised support portions 130 at the corners extend further upward and provide additional support as may be needed at the corner portions of the sidewalls. The extended corner support portions 130 also act as legs when the cover 110 is resting on the ground, as may be shown in FIG. 3. Moreover, the configuration allows for nesting of the covers 110 when stored. The cover 110 is typically a molded plastic member and may include upward extending depressions formed in an underside of the cover 110 that provide added strength and support and decrease the overall weight of the cover. Although a number of the depressions or dimples 126 are shown, other patterns and configurations are well known in the art and may be utilized with the present invention. Moreover, other types of covers that receive a sidewall may also be utilized with the present invention.

Figure 6:
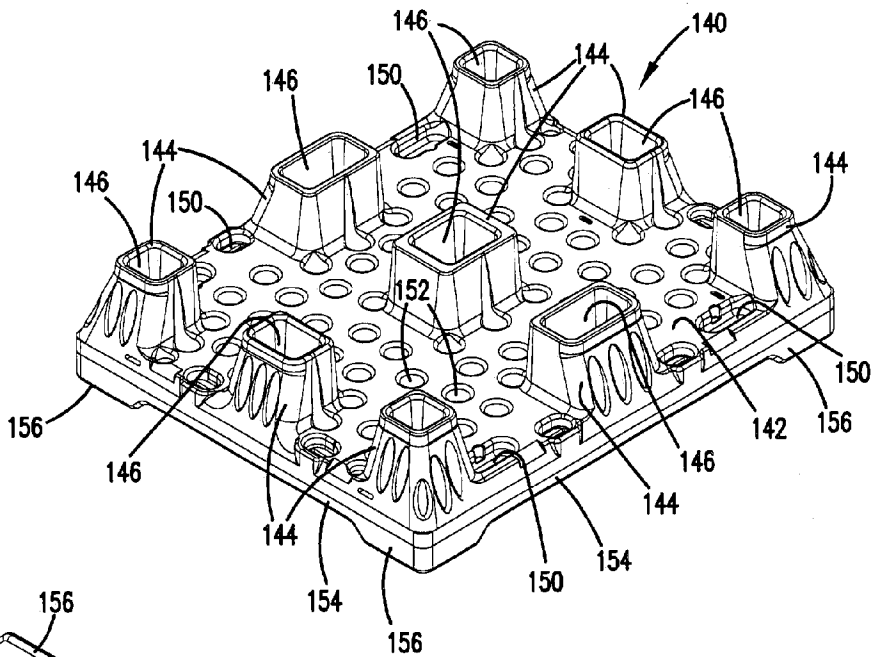
FIG. 6 is a bottom perspective view of the base shown in FIG. 5.
Figure 5:
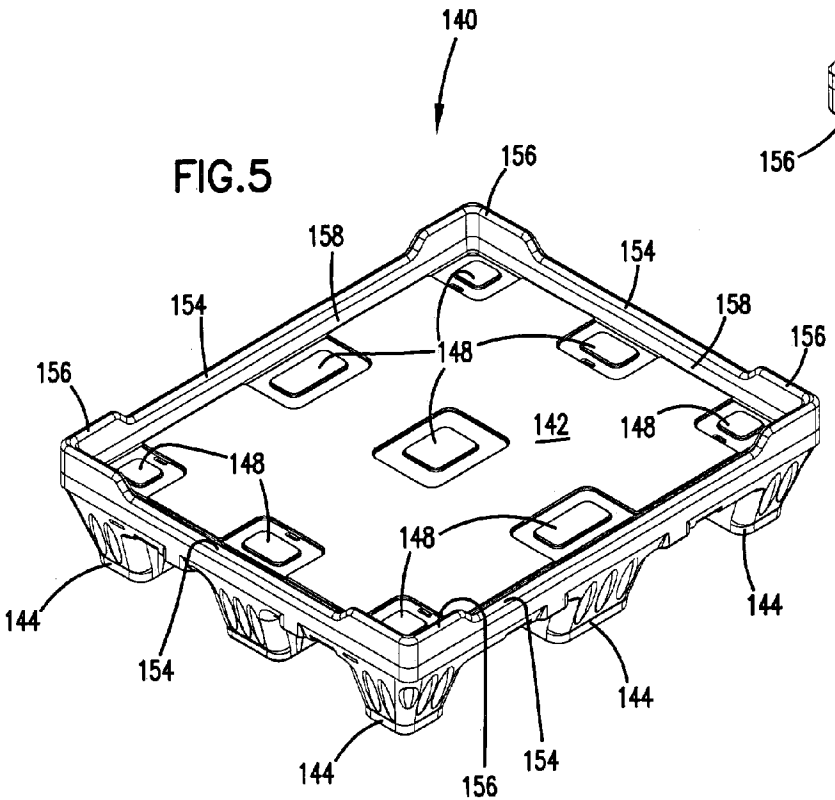
FIG. 5 is a top perspective view of a base for the container shown in FIG. 2.
Figure 7:
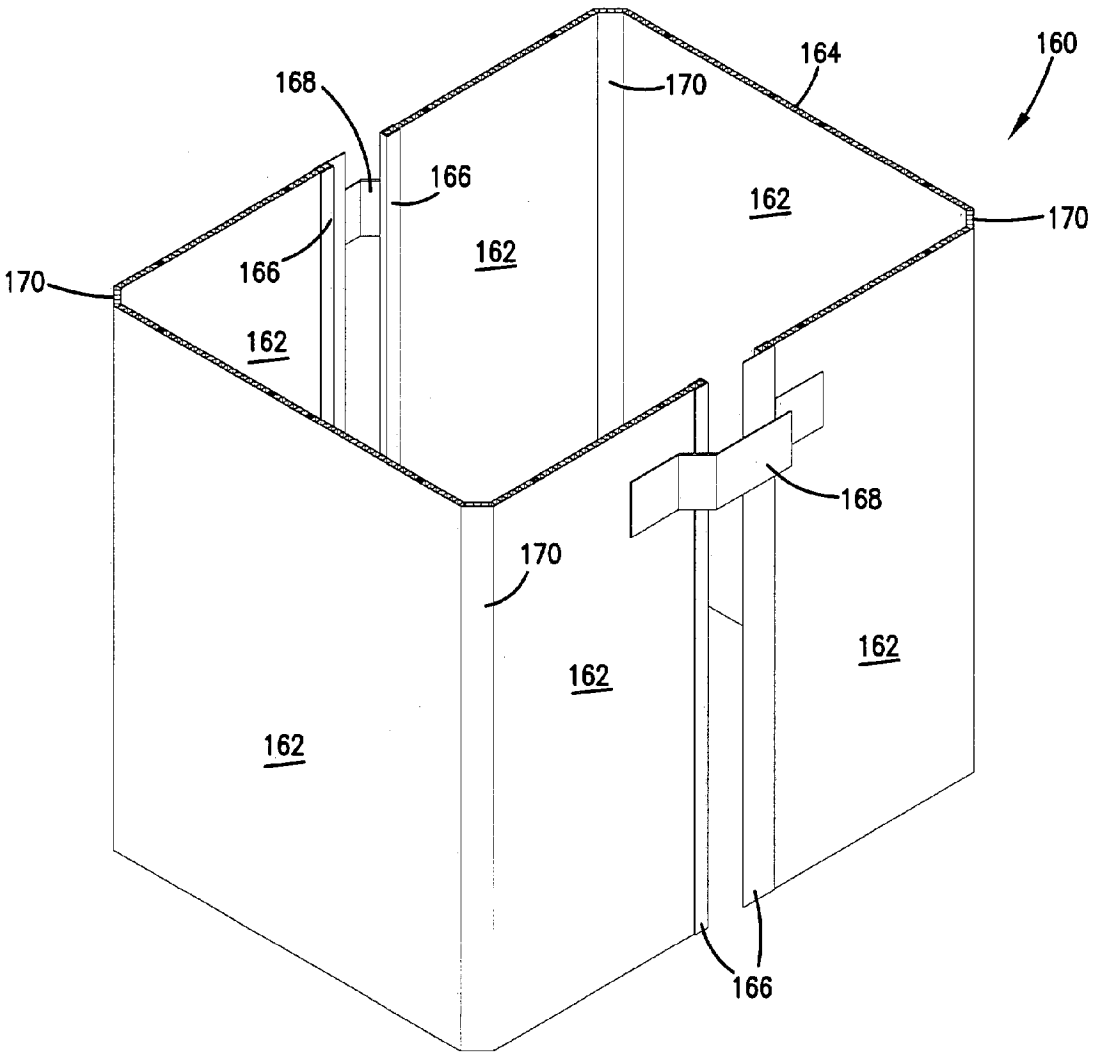
FIG. 7 is a perspective view of a sidewall for the container shown in FIG. 2.
Figure 8:
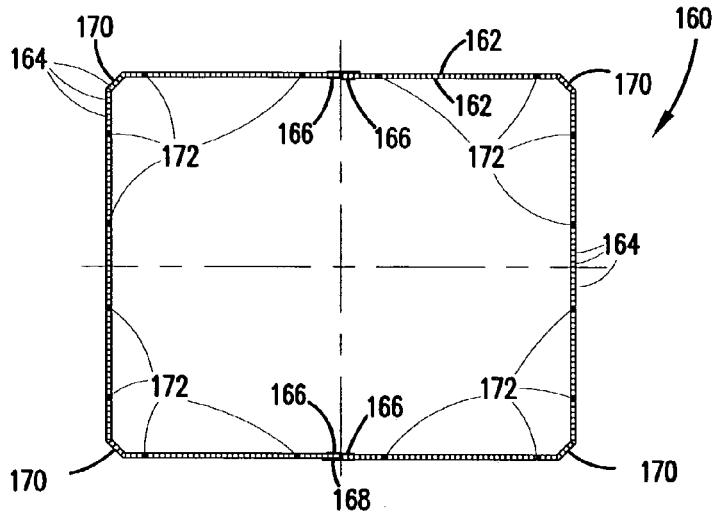
FIG. 8 is a top plan view of the sidewall shown in FIG. 7.
Figure 9:
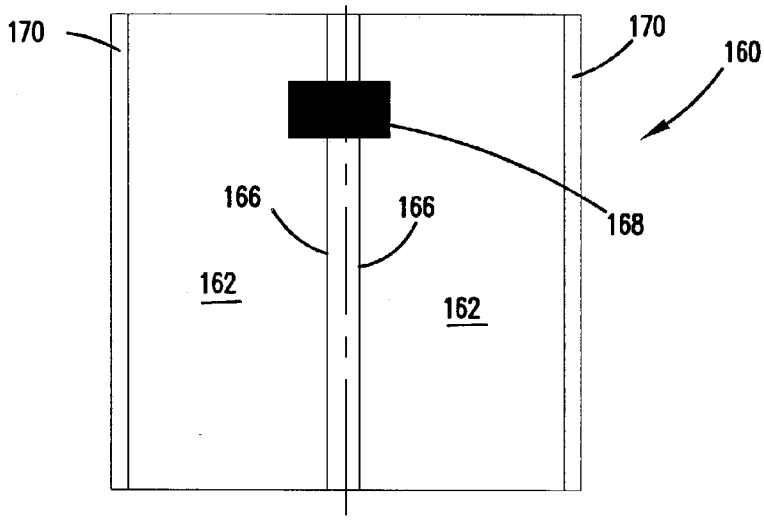
FIG. 9 is a side elevational view of the sidewall shown in FIG. 7.
Figure 10:
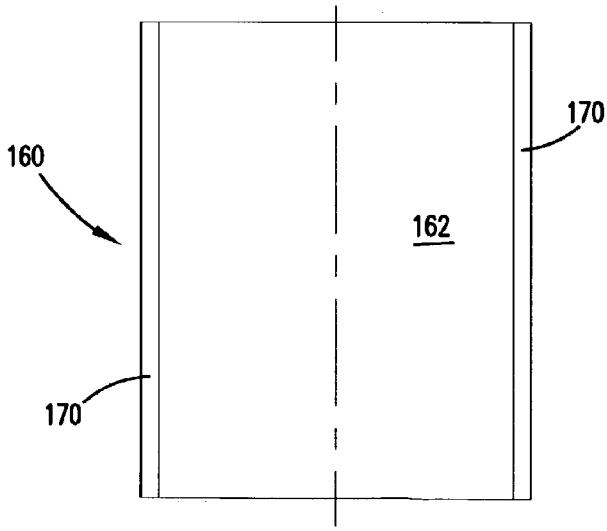
FIG. 10 is a front elevational view of the sidewall shown in FIG. 7.

Referring now to FIGS. 5 and 6, the base 140 is typically a pallet having a deck 142 and legs 144 extending downward and supporting the deck 142. As shown in FIG. 5, an upper surface of the deck has nesting portions 148 formed therein. The nesting portions 148 include a recess surrounding the center portion and are configured for receiving the bottom of the legs 144. As shown in FIG. 6, the legs 144 have upward extending center depressions 146. The bottom surface of the legs 144 extends into the recesses of the nesting portions 148 when the pallets 140 are stacked for storage with the center depression 146 receiving the center of the nesting portion 148. Although nine legs are shown, other configurations are also possible. Moreover, the nesting portions 148 are positioned and shaped similar to those shown on the cover 110 so that the containers 102 and 104 may also be stacked. The pattern of the legs 144 provides for having two straps extend between the legs in each direction and also align with the channels 122 and 124 on the cover 110. With this configuration, the tie down devices may be extended from front to back and side to side for secure retention of the cover 110 and base 140. The legs 144 also allow for easy access by forklifts and pallet jacks.

The pallet 140 also defines hand holds 150 formed therein for easier handling of the pallets 140 when empty. Dimples extend upward into the underside of the pallet 140 of the deck 142. The pallet 140 may be a molded plastic element and the upward extending dimples or depressions 152 in the underside of the pallet 140 provide added strength while decreasing overall weight. While a particular dimple pattern is shown, other patterns are also well known and may be utilized with the present invention. Moreover, other types of bases may be utilized that receive and support a sidewall and are interchangeable with the elements of the present invention.

Referring to FIG. 5, the upper surface of the pallet 140 includes a sidewall channel 158 spaced slightly inward from the periphery of the deck 142. The sidewall channel 158 is surrounded on the exterior by a support wall 154. Raised corner portions 156 extend slightly upward and provide added support to the corner portions of the sidewalls when assembled, in a manner similar to that for the cover 110.

Figure 11:
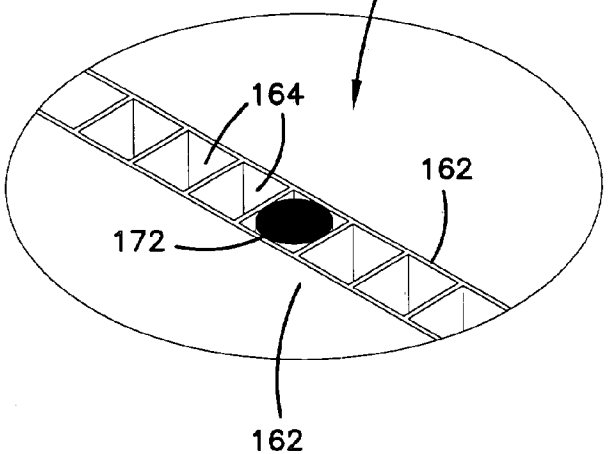
FIG. 11 is a detail view of flutes and reinforcing members for the sidewall shown in FIG. 7.

Referring now to FIGS. 7–10, a first embodiment of a sidewall 160 is shown. The sidewall 160 is a corrugated type element having face portions 162 with flutes 164 defined therebetween. The sidewall is preferably a lightweight, high strength corrugated plastic element. In the embodiment shown, the sidewall 160 has two portions that are joined along a vertical edge by aluminum connectors 166. A strap 168 utilizes Velcro®, more generically known as a hook and loop type fastener or other connectors to join the sidewall as a unitary assembly. The sidewall 160 receives additional support and alignment when assembled from the cover 110 and the pallet 140 due to the receiving channels and outer sidewall portions. The sidewall also includes corner portions that may extend at a 45 degree angle to the major sides of the sidewall, as shown in FIG. 19. In addition to its normal construction, reinforcing rods 172 insert into the flutes 164 of the sidewall 160 for additional reinforcement, as shown more clearly in FIG. 11. To provide additional strength while maintaining light weight, only selected ones of the flutes 164 receive the reinforcing rods. This configuration greatly increases the strength of the sidewall 160 yet maintains low weight and allows the sidewall to be easily handled by a single worker.

Referring now to FIGS. 14–17, a sidewall 180 is shown. The sidewall 180 is similar to sidewall 160, but sidewall 180 is a double wall construction with an inner wall 182 and an outer wall 184. The face portions 186 of each of the walls 182 and 184 define flutes 188. In the inner wall 182, the flutes 188 extend vertically, while in the outer wall 184, the flutes 188 extend horizontally. Corner portions 190, as also shown in FIG. 19, extend at a substantially 45 degree angle to the four wall portions of the sidewall 180. The sidewall 180 may also define a drop down door 196 formed in one side of the sidewall 180. The door 196 is typically also a double wall construction to meet with the inner walls 182 and 184 of the sidewall 180. A portion of one of the walls has a single wall section to overlap with a single wall section at lateral ends of the door 196. The door 196 may be held in place by hook and loop type fasteners (commonly known by the trade name Velcro®) and further retained by a sidewall receiving channel in a cover 110 and support from the sidewall as well as when stored in the container 104.

In addition to the improved strength formed by double wall construction and having flutes extending both vertically and horizontally, the sidewall 180 is also reinforced in a similar manner to the sidewall 160. Vertical reinforcing rods 192 extend in the vertical flutes 188 in the inner sidewall 182. The vertical reinforcing rods 192 are placed in a spaced apart configuration that provides increased strength while not adding substantially to the overall weight of the sidewall 182. In this manner, the sidewall 182 achieves substantially improved strength while maintaining light weight and providing for easy handling by a single worker. The strength achieved with such a lightweight element has achieved surprising capacity. The outer sidewall portion 184 also includes horizontal reinforcing rods 194 that may be placed in flutes 188 extending horizontally in the outer wall 184, as shown in FIG. 18. As with the vertical reinforcing rods 192, it has been found that only one or more horizontal rods 194 is needed to provide improved strength while maintaining low weight.

To assemble and use the container system 100, one of the sidewalls 160 or 180 is inserted into the channel 158 formed in the pallet 140. This configuration has sufficient strength to receive material within the interior space defined by the wall and allows for easy loading through the open top of the sidewall. The outer side supports 154 and 156 provide sufficient restraint and support to the sidewall 160 or 180 to provide for loading. When the interior of the sidewall is filled, the cover 110 is placed on the structure with the top edge of the sidewall 160 or 180 inserting into the channel 124 in the underside of the cover 110. Straps or other securing devices are then wrapped around the container 102 or 104 through the channels 122 and 124 and intermediate the legs 144. The resulting structure has the capacity to carry great weight while providing an easy to handle and stable container. Moreover, the containers 100 may be stacked and the various container elements may be stacked for compact storage. It can also be appreciated that the weight, strength and particular application needed determines which sidewall 160 or 180 may be used. The covers 110 and pallets 140 are interchangeably used with either sidewall 160 or 180. The container system 100 provides for easy and inexpensive manufacturing and quick and easy assembly and disassembly of the containers that are not possible with the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A container, comprising:

a base;

a cover;

a sidewall comprising a corrugated wall setting onto the base and receiving the cover, wherein the corrugated wall defines a plurality of openings extending along a length of the wall, and wherein at least one of the openings includes a reinforcing member inserted therein;

wherein the sidewall comprises a first corrugated wall layer and a second corrugated wall layer overlaying the first corrugated wall layer, wherein the first wall layer defines vertical openings and the second wall layer defines horizontal openings, wherein at least one of the vertical openings includes a reinforcing member inserted therein, and at least one of the horizontal openings includes a reinforcing member inserted therein.

2. A container according to claim 1, wherein the container comprises a plurality of reinforcing members, each of the reinforcing members is inserted into an associated opening.

3. A container according to claim 2, wherein the reinforcing members are spaced apart from one another.

4. A container according to claim 1, wherein the sidewall includes a door.

5. A container according to claim 1, wherein the base comprises a stackable pallet.

6. A container according to claim 1, wherein the sidewall, cover and base form an enclosed space.

7. A container according to claim 1, wherein the sidewall forms a rectangular periphery.

8. A container according to claim 1, wherein the base and the cover are configured to nest when the container is stacked on another like container.

9. A container according to claim 1, wherein the cover and the base include support portions engaging an outer portion of the sidewall.

10. A container according to claim 1, wherein the base defines a channel for receiving the sidewall.

11. A container according to claim 1, wherein the cover defines a channel for receiving the sidewall.

12. A container system, comprising:

a base;

a cover;

interchangeable sidewalls setting onto the base and receiving the cover, including:

a first sidewall comprising a corrugated wall wherein the corrugated wall defines a plurality of openings extending along the wall, and wherein at least one of the openings includes a reinforcing member inserted therein; and a second sidewall comprising a first corrugated wall portion defining a plurality of vertically extending openings along the first wall portion, and wherein at least one of the vertically extending openings includes a reinforcing member inserted therein, and a second corrugated wall portion overlaying the first corrugated wall portion, wherein the second corrugated wall portion defines a plurality of horizontally extending openings, and wherein at least one of the horizontally extending openings includes a reinforcing member inserted therein.

13. A system according to claim 12, wherein the first and second sidewalls comprise corrugated plastic.

* * * * *